US006201142B1

(12) United States Patent
Maza

(10) Patent No.: US 6,201,142 B1
(45) Date of Patent: Mar. 13, 2001

(54) PROCESS FOR RECOVERY OF CORN OIL FROM CORN GERM

(75) Inventor: Aurelia Maza, Livingston, NJ (US)

(73) Assignee: Bestfoods, Englewood Cliffs, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/996,859

(22) Filed: Dec. 23, 1997

(51) Int. Cl.[7] ..... C11B 1/00

(52) U.S. Cl. ..... 554/16; 554/12; 554/15; 426/430; 426/651

(58) Field of Search ..... 554/15, 12, 14; 426/430, 651

(56) References Cited

U.S. PATENT DOCUMENTS

| | | | |
|---|---|---|---|
| 1,438,194 | 12/1922 | Stokes . | |
| 1,616,319 | 2/1927 | Kammermann . | |
| 1,760,059 | 5/1930 | Hiller . | |
| 2,216,658 | 10/1940 | Anderson . | |
| 2,277,055 | 3/1942 | Anderson . | |
| 2,280,046 | 4/1942 | Musher . | |
| 2,533,858 | 12/1950 | Weigel . | |
| 3,255,220 | 6/1966 | Baer . | |
| 3,257,209 | 6/1966 | Lewis . | |
| 3,385,709 | 5/1968 | Wenger et al. . | |
| 3,615,655 | 10/1971 | Freeman . | |
| 3,696,891 | 10/1972 | Poe . | |
| 3,958,027 | 5/1976 | Alexander et al. . | |
| 4,009,290 | 2/1977 | Okumori et al. . | |
| 4,122,104 | 10/1978 | Witte . | |
| 4,246,184 | 1/1981 | Pressick et al. . | |
| 4,277,411 | 7/1981 | Yahl . | |
| 4,325,882 | 4/1982 | Reiners . | |
| 4,341,713 | 7/1982 | Stolp . | |
| 4,442,034 * | 4/1984 | Suzuki et al. | 260/236 |
| 4,794,011 | 12/1988 | Schumacher . | |
| 4,808,426 | 2/1989 | Strop et al. . | |
| 4,874,555 | 10/1989 | Upchurch . | |
| 4,901,635 | 2/1990 | Williams . | |
| 4,944,954 | 7/1990 | Strop . | |
| 5,077,071 | 12/1991 | Strop . | |
| 5,200,229 | 4/1993 | Strop . | |

* cited by examiner

*Primary Examiner*—Deborah Carr
(74) *Attorney, Agent, or Firm*—Ellen Plotkin

(57) ABSTRACT

An efficient process for recovering high quality corn oil from corn germ. The process involves pre-treating corn germ by Rehydration, conditioning and, optionally flaking. This is followed by extrusion, which is the core operation in the preparation of corn germ for corn oil recovery. Water is provided up front in the process, prior to extrusion. Providing water up front reduces generation of fines and improves friction within the extruder, thereby allowing the material to move along and improving overall efficiency and streamlining of the process. The oil released from corn germ by this process is of high quality and high yield.

21 Claims, 5 Drawing Sheets

PROCESS FOR RECOVERY OF CORN OIL FROM CORN GERM

FIELD OF INVENTION

Figure 1:
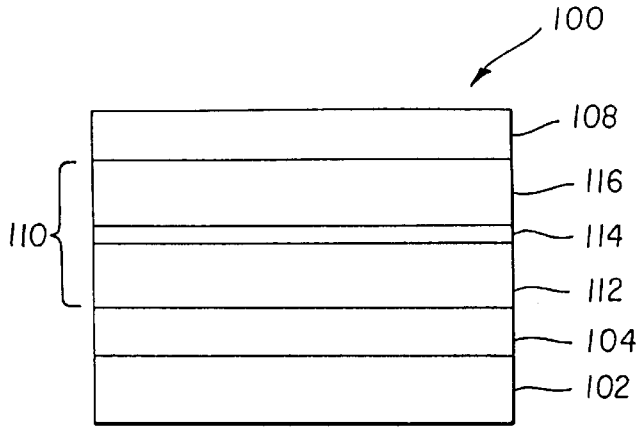
Figure 2:
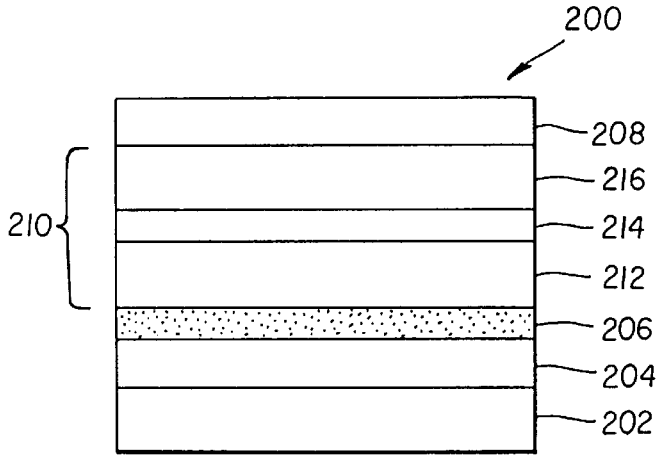
Figure 3:
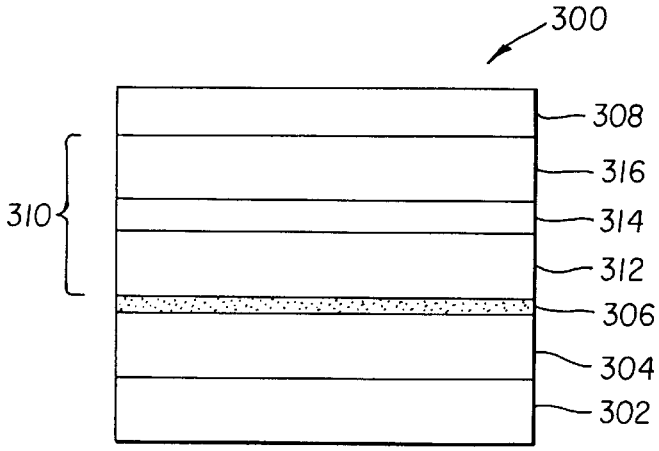
Figure 4:
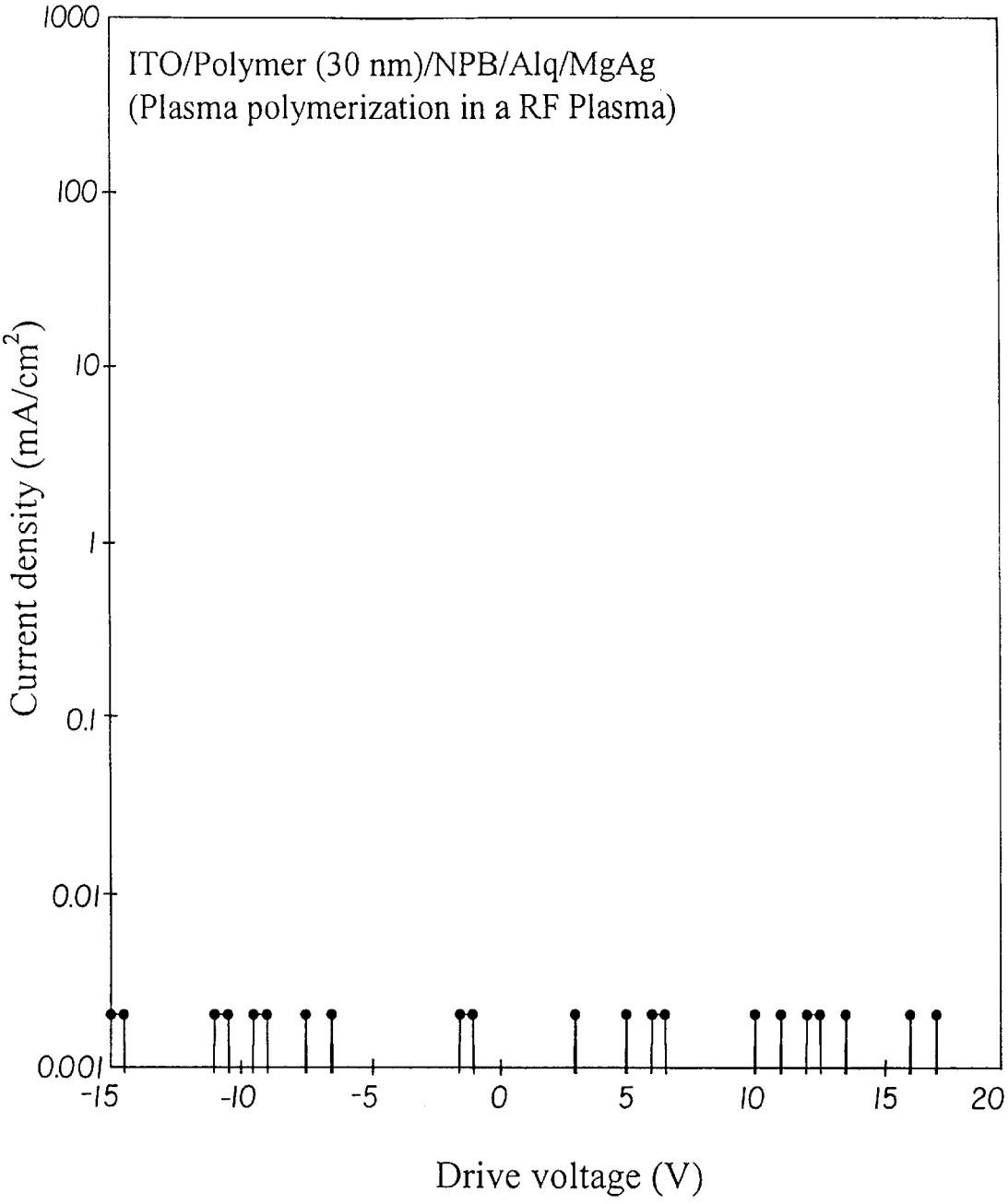
Figure 5:
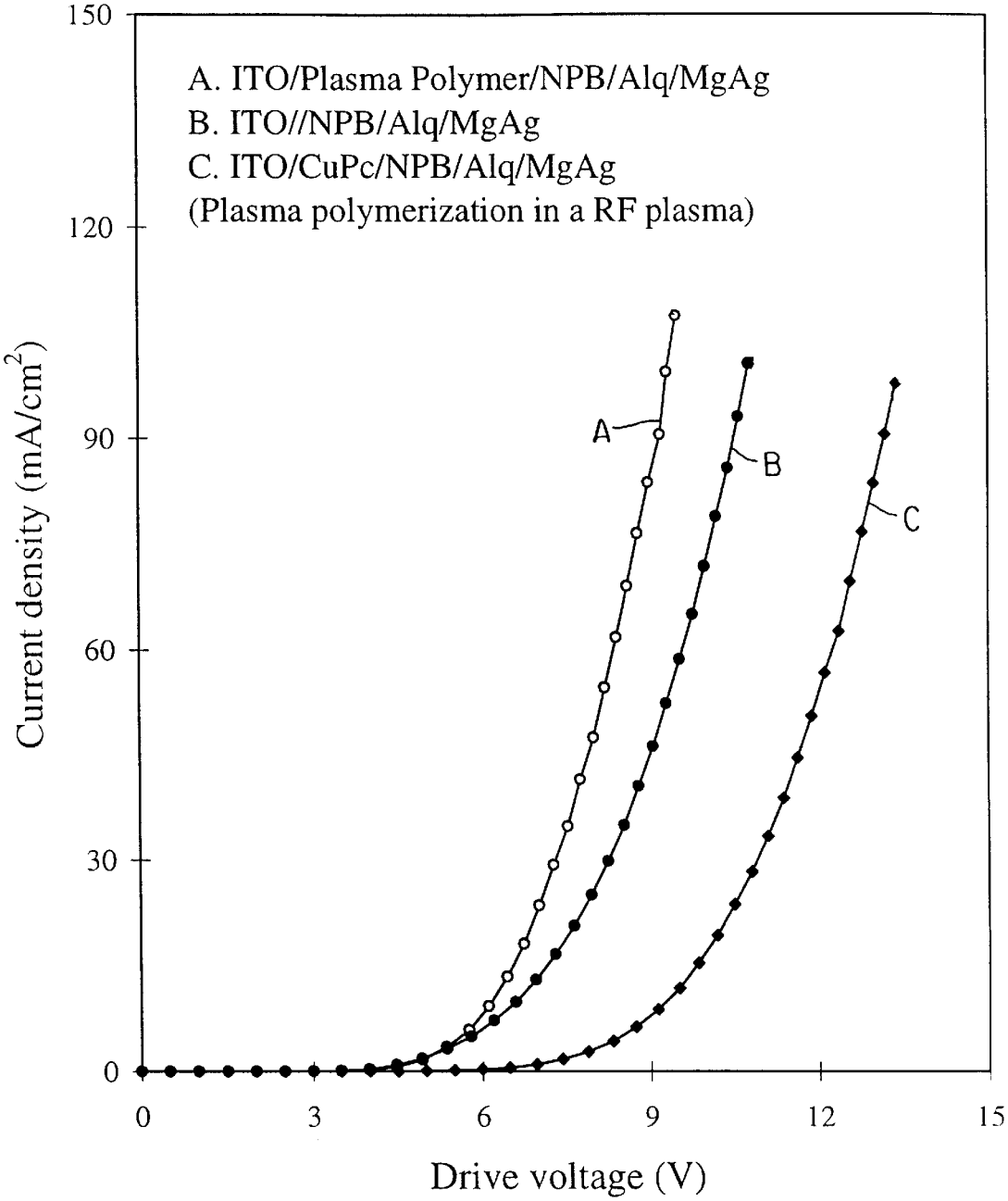
Figure 6:
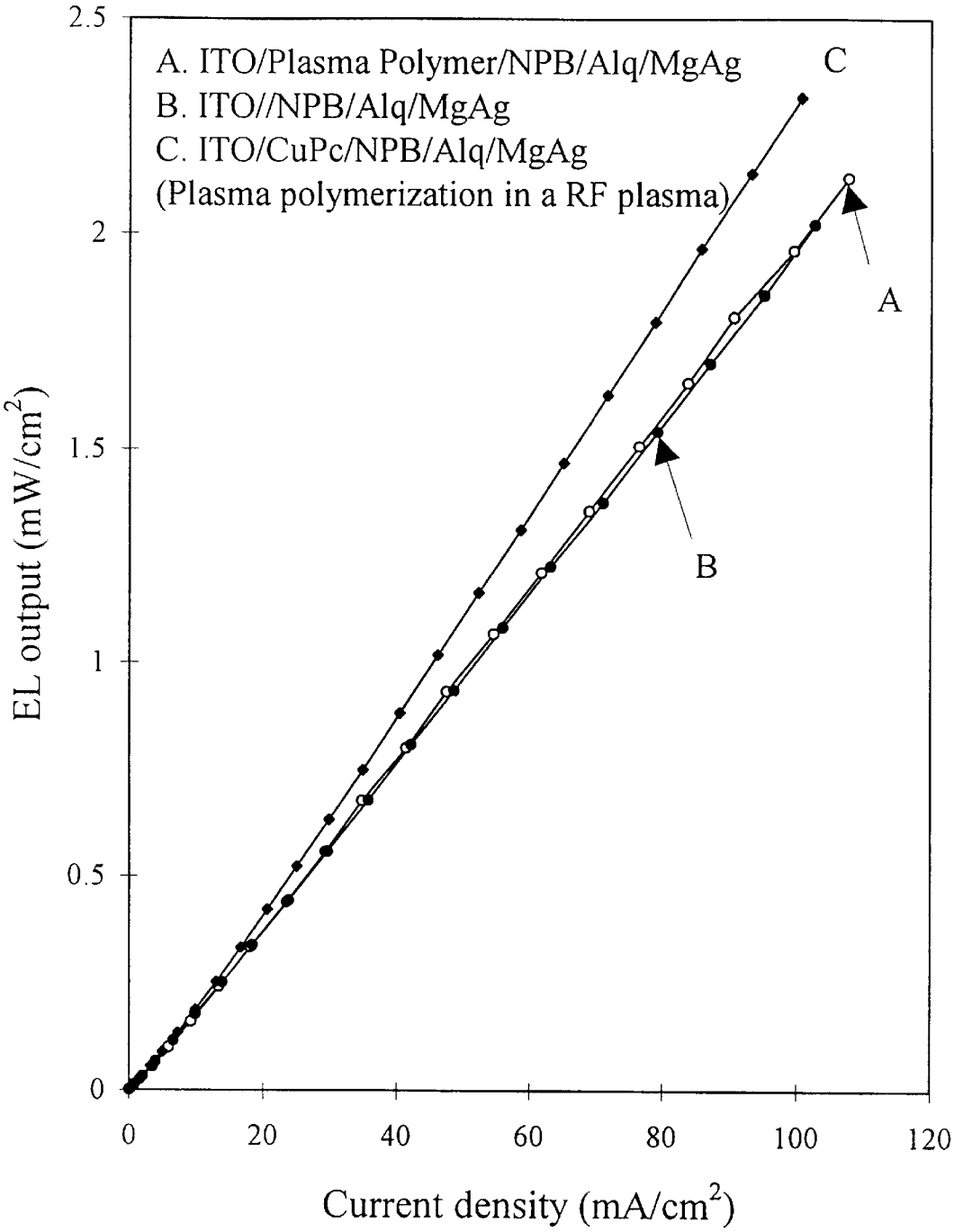
Figure 7:
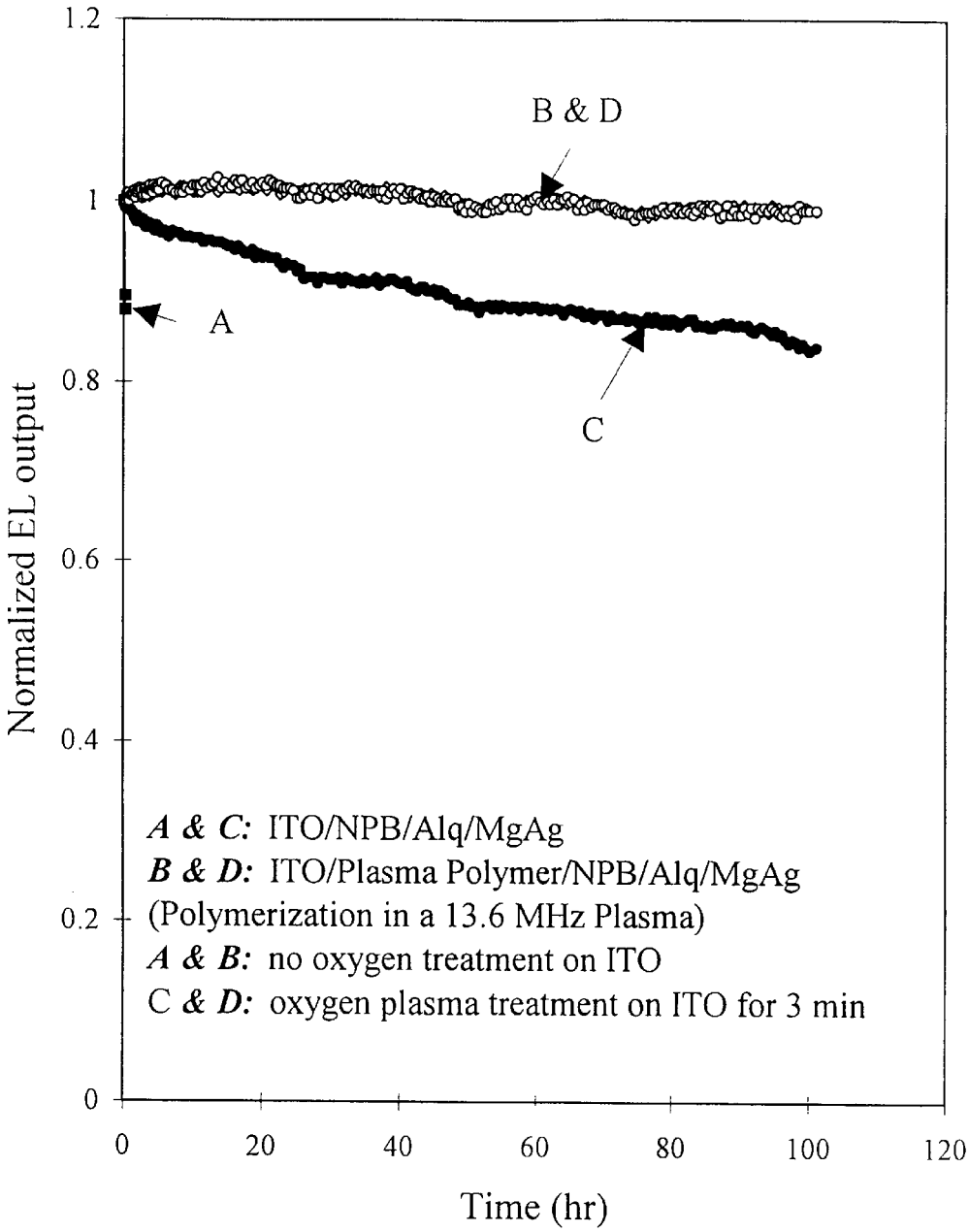

The present invention relates to a process of recovering oil from corn germ. More particularly, it relates to processes for pre-treating corn germ, recovering oil therefrom, and producing a high quality corn oil.

BACKGROUND

Although edible oils, such as corn oil, soybean oil, sunflower oil, rape seed oil, etc. are generally interchangeable in cooking applications, corn is significantly different from other oil-bearing seeds when it comes to the recovery of oil from the seed. As opposed to the soybean kernel, the whole of which contains oil, only a small portion of the corn kernel bears oil. Corn germ is the oil-bearing portion of a kernel of corn. This difference affects the rate of extraction of oil from soybean versus from corn kernels. Another difference is that corn germ has a higher oil content than other seeds. Corn germ obtained by wet milling contains 48–52% oil, whereas that obtained by dry milling containing 25–30% oil. In contrast, soybean contains 17–20% oil by weight; rapeseed (canola) contains about 42% oil; cottonseed (29%); sunflower meals (32%), etc.

Solvent extraction is a standard method for recovering oil from oil seeds. However, corn germ cannot be directly extracted with solvent after preparation by flaking, as is done for other oil seeds, because of its tendency to produce a substantial amount of fines which hinder solvent extraction. Consequently, the traditional means of oil liberation from corn germ containing 25– 52% oil have resorted to mechanical expression/pressing/expelling. Expelling is conducted to various degrees of oil recovery and may be followed by solvent extraction, for economical reasons.

One conventional process for germ preparation and oil extraction uses dry germ as a starting material. The processing steps include Rehydration, followed by Cooking, and the Full Expelling operation which yields an oil stream. Corn germ is expelled to 6–10% residual oil content which is the lowest oil level economically attainable through direct pressing. In order to enhance oil recovery economics, both germ preparation and germ expelling need to be conducted at high temperatures (250–275° F.). The majority of expelled oil is recirculated in hot and aerated state onto the expeller for external cooling of the barrel, while the quota withdrawn continually is processed hot. As a result, decomposition products leach out of the expeller cake along with the oil recovered. More decomposition products develop further through prolonged handling of hot oil.

In another conventional process for germ preparation and oil extraction, dry germ is Rehydrated, and then Cooked. The cooked corn germ is subsequently expelled to 20–30% residual oil content under similar conditions as in full expelling, discussed in the previous paragraph (example h). This Pre-expelling operation yields an oil stream. The expelled corn germ is again Rehydrated, and then Flaked. In order to enhance oil recovery economics, pre-expelled cake is extracted with solvent to 3–4% residual oil content. This Extraction operation yields another oil stream. Hot solvent extracts more degradation products out of the expeller cake. Consequently, the quality of crude oil (blend of pre-expelled and extracted oils) is inferior to full expelling.

A better process is to use Extrusion as part of the pre-treatment process of corn germ, prior to the oil liberation step. Extrusion has been very effective in improving the solvent extractability of many oleaginous plant materials. Extrusion is well established in the preparation of soybean, rice bran, cottonseed, and pre-pressed canola, sunflower and other oilseeds. However, there are some problems in the extrusion of oleaginous plant materials having a high percentage of oil by weight, e.g., more than 30%. For example, the disclosure of Williams, U.S. Pat. No. 4,901,635, addresses the problems of oil liberation occurring within the extruder as corn germ materials (having more than 30% oil) is processed through the extruder. The liberated oil forms pockets of free oil which squirt out of the dies and interrupt steady-state operation of the extruder. The squirting oil also results in the undesirable loss of oil, the principal product. Williams avoids this problem by providing an extruder apparatus having a means for draining oil liberated from the material during extrusion. A disadvantage with draining out the oil in such a way is that the hot oil will become oxidized. The drainage phenomenon and the oil stream generated thereby are undesirable process elements, because they disrupt process streamlining and make possible oil abuse. Also, it would be advantageous to avoid oil liberation problems through process modifications, so that any conventional extruder could be utilized, which is one of the objects of the present invention.

In a conventional process for germ preparation and oil extraction, like that described in Williams, U.S. Pat. No. 4,901,635, dry germ undergoes several size reduction and conditioning operations at ambient or relatively mild temperature (less than 180° F.), including the steps of Cracking, followed by Conditioning. It is then extruded rapidly at medium temperature (220–230° F.). As a result of extrusion, the oil released remains attached to, or absorbed onto, the porous meal produced through matrix disruption and partial starch gelatinization. Extruded meal is subjected to extraction with solvent to 4–5% residual oil content. The extraction operation yields an oil stream. Due to relatively short exposure time and milder temperature, both meal and oil abuse is limited. Nevertheless, due to extensive size reduction treatment implemented on dry and brittle germ, the process generates substantial quantities of fatty fines. Fines impact on extruded material by making it less porous. Fines retained on the meal reduce extraction efficiency. Additionally, in an air-borne state, fines represent a safety hazard. Greasy fines get into ventilation, which could lead to spontaneous fires.

Accordingly, it is an object of the present invention to provide a non-abusive means of oil release from corn germ.

It is another object of the present invention to enhance oil release from corn germ and to improve oil recovery yield, as well as oil quality.

Another object of the present invention is to rupture oil cells of corn germ to increase solvent extraction rates and improve extraction efficiency.

Another object of the present invention is to reduce fines generated in the process of recovering oil from corn germ, thereby eliminating safety hazards caused by fines.

Another object of the present invention is to reduce capital equipment costs.

Another object of the present invention is to simplify auxiliary operations before and after extrusion as to accomplish a short, streamlined process sequence, which is easier to control than prior known processes.

Another object of the present invention is to achieve enhanced extraction and reduced solvent loss during extraction.

The present invention contemplates a new and improved overall process which provides more efficient processing of a better quality corn oil.

Other objects and advantages of the invention will be apparent from a study of the following specification.

In the present specification and claims, all parts and percentages are by weight, unless otherwise specified.

SUMMARY OF THE INVENTION

In accordance with the invention, an efficient process for recovering high quality corn oil from corn germ is provided. The process involves pre-treating corn germ by Rehydration, Conditioning and, optionally Flaking. This is followed by Extrusion, which is the core operation in the preparation of corn germ for corn oil recovery. Water is provided up front in the process, prior to extrusion. Providing water up front reduces generation of fines and improves friction within the extruder, thereby allowing the material to move along and improving overall efficiency and streamlining of the process. The oil released from corn germ by this process is of high quality and high yield.

DETAILED DESCRIPTION OF INVENTION

The following detailed description is by way of example, not by way of limitation, of the principles of the invention to illustrate the best mode of carrying out the invention. The invention relates to the preparation of a meal from wet milled corn germ. Wet milled corn germ presents a particular oil removal challenge due to its high oil content (twice that of corn germ from the dry milling process.) The present invention meets this challenge. The meal prepared from corn germ by the extrusion-based processes (described in the Examples) is subjected to solvent extraction either to remove the oil (examples a–c) or to complete the partial removal accomplished in the pre-expelling operation (Examples d–f).

EXAMPLE a

Wet corn germ from the wet milling process, containing about 50% moisture by weight, is dried partially to the level of moisture necessary for the oil recovery process, to about 15 to 20% water, preferably 17% water. No Rehydrations, or moisture adjustments, are required since the wet corn germ is only partially dried to the critical moisture level of 15–20%. Wet corn germ provides water up front in the process, to improve friction within the barrel of the extruder and to allow the material to move along. The elevated moisture level in the extruder makes the corn germ less abrasive, i.e., less friction. The reduced friction reduces wear on the extruder.

The partially dry corn germ is conditioned for a short time at a temperature of 160–180° F., preferably 175–180° F., for 15–30 minutes, preferably 30 minutes. The Conditioning step is a heat treatment step which helps to soften corn germ for Flaking.

After being conditioned, the corn germ is flaked hot (140–160° F.) to form thin, flat, essentially two-dimensional flakes having a thickness of 0.008–0.012 inches (0.02–0.03 mm). Flaking is done between rollers within intermeshing grooves so that flattened flakes emerge. The flaking mill functions to squeeze and impart a slight shear to the conditioned corn germ resulting in the formation of a thin flat flake having a thickness of about 0.008–0.012 inches. The resulting flat, thin flakes are much easier to extract oil from, as compared with spherical powder particles that may be produced by steps such as pulverizing.

Extrusion is an oil release technique which is based on the explosion of the oil seed matrix by controlled evaporation of cellular moisture. According to the present invention, Extrusion is employed as the core operation in the preparation of corn germ for the recovery of corn oil. To this end, Extrusion is incorporated with other means of grain processing, where Extrusion functions as a non-abusive means to accomplish or to enhance oil removal relative to that done by conventional procedures.

During the pre-treating operations of Rehydrating (when start with dry germ, as in the following examples), Conditioning, and, optionally, Flaking, a substantial part of the moisture diffuses into the oil cells. The material so prepared is force-fed through the extruder at high rate and low-to-medium temperature, preferably 180–230° F., along with water or live steam. The temperature of the material increases from the inlet to the discharge of the extruder. Relative to the germ being fed through, the amount of water or steam used is preferably 0–15 weight %. During the short residence time available in the extruder, less than 1 minute, the material develops enough mild positive pressure to complete cellular water diffusion but insufficient to produce oil expelling. Under the specific temperature/moisture/pressure/time conditions, corn germ starch and proteins are partially gelatinized and denatured, respectively. Preferably, the pressure is 5–50 psig on die plate before extrusion. The material is forced out of the extruder through a restrictive device, known as a die, into an environment of lower pressure than within the extruder. As a result of the abrupt change of pressure, cellular water vaporizes instantly, rupturing the cells and releasing germ oil within the extruded meal. At given extrusion conditions, the fatty fines which may have been produced previously during flaking are agglomerated back with the extruded germ into a highly porous mass which retains the oil. The extruded material may be produced in either pellet or non-aggregated form.

Wet, hot pellets should be cooled immediately, to avoid crumbling. The hard, porous material produced by the extrusion step is very suitable for solvent extraction. In fact, the porosity in the pre-treated corn germ material improves extractability of oil in the subsequent oil removal from the solids, i.e., improved efficiency, while the hardness of the porous material avoids crumbling during the subsequent Extraction step (or other means of oil removal). The small particles would prevent adequate flow of solvent through a bed of the pre-treated corn germ material in the extractor.

The short residence time in the extruder, as well as the relatively mild temperature and pressure conditions reduce any deleterious side effects on the corn germ being processed. This results in improved oil quality.

The extrusion operation can be followed by direct solvent (such as hexane or isopropyl alcohol) extraction or by partial oil recovery through pressing and subsequently extraction. The extraction process produces crude oil suitable for refining. In this Example, the meal prepared from corn germ by the extrusion-based pre-treatment process described above is then subjected to solvent extraction in order to remove the oil, yielding a single oil stream. The Extraction step is preferably carried out with hexane at a temperature of about 140° F.

As a variation on this process sequence, the size reduction operation is omitted, i.e., the Flaking step is not included. This means that the processing can be done with unbroken whole germ, which is a unique feature of the present invention. The fact that Flaking is optional, or that both flaked germ and whole germ can be extruded, is an advantage of the process of the present invention. One aspect of the advantage lies in minimization of capital asset expenditures, space requirements, and energy consumption.

EXAMPLE b

Wet corn germ from the wet milling process, containing about 50% moisture by weight, is dried completely to about 4% water. After appropriate storage or transportation, the dry germ is rehydrated to about 15 to 20%, preferably 17% moisture, for further processing. This Rehydration step is preferably carried out at temperatures of 75–80° F. for about 30 minutes. Rehydration is critical. This is where all the water necessary for the process is introduced up front, in order to reduce fines. Only minimal quantities of water are introduced into the system in operations downstream, specifically to compensate for evaporation losses or to increase the friction inside the extruder, thus avoiding oiling/drainage.

After being rehydrated, the corn germ is conditioned, or heat treated, for a short time at a temperature of 160–180° F., preferably 175–180° F., for 15–30 minutes, preferably 30 minutes. The Rehydration and Conditioning steps help to soften and prepare corn germ for flaking, thereby making Flaking easier. The Rehydration step involves the addition of water early in the process, thereby eliminating fines that would otherwise be produced by the next, Flaking Step.

After being rehydrated and conditioned, the corn germ is flaked hot as described in the Flaking step of Example a.

Flaking is followed by the Extrusion step, as described in Example a. The water provided up front, during the Rehydration step, improves friction within the barrel of the extruder and allows the material to move along. The elevated moisture level in the extruder makes the corn germ less abrasive, i.e., less friction. The reduced friction reduces wear on the extruder.

The meal prepared from corn germ by this extrusion-based pre-treatment process described above is then subjected to solvent extraction in order to remove the oil, yielding a single oil stream. The Extraction step is preferably carried out with hexane at a temperature of about 140° F.

As a variation on this process sequence, the size reduction operation is omitted, i.e., the Flaking step is not included. This means that the processing can be done with unbroken whole germ, which is a unique feature of the present invention. The fact that Flaking is optional, or that both flaked germ and whole germ can be extruded, is an advantage of the process of the present invention. One aspect of the advantage lies in minimization of asset expenditures, space requirements, and energy consumption.

Process sequences of Examples a and b are two preferred embodiments of the present invention.

EXAMPLE c

Wet corn germ from the wet milling process, containing about 50% moisture by weight, is dried completely to about 4% water and is followed by chaff removal. Chaff removal/incorporation is an extraction aid. It provides absorbent cushion should oil-out occur like in Williams, U.S. Pat. No. 4,901,635 (discussed in the Background section).

After appropriate storage or transportation, the dry germ is rehydrated to about 15 to 20%, preferably 17% moisture, for further processing. The Rehydration step involves the addition of water early in the process, thereby eliminating fines that would otherwise be produced by the next, Flaking Step. Rehydration is critical. This is where all the water necessary for the process is introduced up front, in order to reduce fines. Only minimal quantities of water are introduced into the system in operations downstream, specifically to compensate for evaporation losses or to increase the friction inside the extruder, thus avoiding oiling/drainage.

After being rehydrated, the corn germ is conditioned, or heat treated, for a short time at a temperature of 160–180° F., preferably 175–180° F., for 15–30 minutes, preferably 30 minutes. The Rehydration and Conditioning steps help to soften and prepare corn germ for flaking, thereby making Flaking easier.

After being rehydrated and conditioned, the corn germ is flaked hot as described in the Flaking step of Example a.

Flaking is followed by chaff incorporation into the extruder.

The Extrusion step is carried out as described in Example a. The water provided up front, during the Rehydration step, improves friction within the barrel of the extruder and allows the material to move along. The elevated moisture level in the extruder makes the corn germ less abrasive, i.e., less friction. The reduced friction reduces wear on the extruder.

The meal prepared from corn germ by the extrusion-based pre-treatment process described above is then subjected to solvent extraction in order to remove the oil, yielding a single oil stream. Preferably, hexane is used as a solvent.

EXAMPLE d

Wet corn germ from the wet milling process, containing about 50% moisture by weight, is dried completely to about 4% water. After appropriate storage or transportation, the dry germ is rehydrated to about 15 to 20%, preferably 17% moisture, for further processing. The Rehydration step involves the addition of water early in the process, thereby eliminating fines that would otherwise be produced by the next, Flaking Step. Rehydration is critical. This is where all the water necessary for the process is introduced up front, in order to reduce fines. Only minimal quantities of water are introduced into the system in operations downstream, specifically to compensate for evaporation losses or to increase the friction inside the extruder, thus avoiding oiling/drainage.

After being rehydrated, the corn germ is conditioned, or heat treated, for a short time at a temperature of 160–180° F., preferably 175–180° F., for 15–30 minutes, preferably 30 minutes. The Rehydration and Conditioning steps help to soften and prepare corn germ for flaking, thereby making Flaking easier.

After being rehydrated and conditioned, the corn germ is flaked as described in the Flaking step of Example a.

Flaking is followed by the Extrusion step, as described in Example a. The water provided up front during the Rehydration step, improves friction within the barrel of the extruder and allows the material to move along. The elevated moisture level in the extruder makes the corn germ less abrasive, i.e., less friction. The reduced friction reduces wear on the extruder.

The meal prepared from corn germ by this extrusion-based process is subjected to Pre-expelling. Pre-expelling of oil is carried out to a residual oil content of 50% to 25% oil. This step yields an oil stream and makes the subsequent extraction step more efficient (less load).

This is followed by solvent extraction in order to complete the partial removal of oil accomplished in the pre-expelling operation. Preferably, hexane is used as a solvent.

EXAMPLE e

Wet corn germ from the wet milling process, containing about 50% moisture by weight, is dried completely, to about 4% water, to form dry germ. After appropriate storage or transportation, the dry germ is rehydrated to about 15 to 20%, preferably 17% moisture, for further processing. The Rehydration step involves the addition of water early in the process, thereby eliminating fines that would otherwise be produced by the next, Flaking Step. Rehydration is critical. This is where all the water necessary for the process is introduced up front, in order to reduce fines. Only minimal quantities of water are introduced into the system in operations downstream, specifically to compensate for evaporation losses or to increase the friction inside the extruder, thus avoiding oiling/drainage.

After being rehydrated, the corn germ is conditioned, or heat treated, for a short time at a temperature of 160–180° F., preferably 175–180° F., for 15–30 minutes, preferably 30 minutes. The Rehydration and Conditioning steps help to soften and prepare corn germ for flaking, thereby making Flaking easier.

After being rehydrated and conditioned, the corn germ is flaked hot as described in the Flaking step of Example a.

Flaking is followed by the Extrusion step, as described in Example a. The water provided up front, during the Rehydration step, improves friction within the barrel of the extruder and allows the material to move along. The elevated moisture level in the extruder makes the corn germ less abrasive, i.e., less friction. The reduced friction reduces wear on the extruder.

This is followed by cooking to loosen up oil clinging to extruded material and to reduce viscosity by heating in the presence of moisture. Cooking may take place within the extruder.

Cooking is followed by Pre-expelling. Pre-expelling of oil is carried out to a residual oil content of 50% to 25% oil. This step yields an oil stream and makes the subsequent extraction step more efficient (less load).

The pre-expelled material is subjected to solvent extraction in order to complete the partial removal of oil accomplished in the pre-expelling operation. Preferably, hexane is used as a solvent.

EXAMPLE f

Wet corn germ from the wet milling process, containing about 50% moisture by weight, is dried completely, to about 4% water, to form dry germ.

After appropriate storage or transportation, the dry germ is rehydrated. For this process sequence, the initial Rehydration is preferably to 8 to 10% moisture. The Rehydration step involves the addition of water early in the process.

The pre-expelling of oil is carried out to a residual oil content of 50% to 25% oil. This step yields an oil stream, results in prepressed germ cake and enhances the subsequent extraction step more efficient (less load).

The pre-expelled germ is again rehydrated, now to about 15 to 20%, preferably 17% moisture, for further processing. Rehydration is critical. This is where all the water necessary for the process is introduced up front, in order to reduce fines. Only minimal quantities of water are introduced into the system in operations downstream, specifically to compensate for evaporation losses or to increase the friction inside the extruder, thus avoiding oiling/drainage.

After being rehydrated, the corn germ is conditioned for a short time at a temperature of 160–180° F., preferably 175–180° F., for 15–30 minutes, preferably 30 minutes. The Conditioning step is a heat treatment step which helps to soften corn germ for flaking.

Conditioning is followed by the Extrusion step, as described in Example a. The water provided up front, during the Rehydration step, improves friction within the barrel of the extruder and allows the material to move along. The elevated moisture level in the extruder makes the corn germ less abrasive, i.e., less friction. The reduced friction reduces wear on the extruder.

The meal prepared from corn germ by this extrusion-based process is subjected to solvent extraction in order to complete the partial removal of oil accomplished in the pre-expelling operation. Preferably, hexane is used as a solvent.

In this process sequence, there is no Flaking. Rather, the process can advantageously be conducted with unbroken whole germ. Also, in this sequence, Extrusion is applied to prepressed germ cake in order to enhance matrix disruption and oil release.

EXAMPLE g

The process sequence of this example involves no solvent extraction. Wet corn germ from the wet milling process, containing about 50% moisture by weight, is dried completely to about 4% water. After appropriate storage or transportation, the dry germ is rehydrated to about 15 to 20%, preferably 17% moisture, for further processing. The Rehydration step involves the addition of water early in the process, thereby eliminating fines that would otherwise be produced by the next, Flaking Step. Rehydration is critical. This is where all the water necessary for the process is introduced up front, in order to reduce fines. Only minimal quantities of water are introduced into the system in operations downstream, specifically to compensate for evaporation losses or to increase the friction inside the extruder, thus avoiding oiling/drainage.

After being hydrated, the corn germ is conditioned, or heat treated, for a short time at a temperature of 160–180° F., preferably 175–180° F., for 15–30 minutes, preferably 30 minutes. The Rehydration and Conditioning steps help to soften and prepare corn germ for flaking, thereby making Flaking easier.

After being rehydrated and conditioned, the corn germ is flaked hot, as described in the Flaking step of Example a.

Flaking is followed by the Extrusion step, as described in Example a. To provide water up front, to improve friction within the barrel of the expander and to allow the material to move along. The elevated moisture level in the extruder makes the corn germ less abrasive, i.e., less friction. The reduced friction reduces wear on the extruder.

The extruded mass is passed on to the Full Expelling step during which oil is expelled from the pre-treated corn germ. The oil content of the pre-treated corn germ is reduced from about 50% to about 8%.

The present invention is particularly applicable to the recovery of oil from wet mill process corn germ, but is also applicable to many other vegetable oil bearing materials. These materials may include dry process corn germ, rapeseed, cotton seed, peanuts, sunflower seed, soybean, and the like.

From the foregoing description, one skilled in the art can readily ascertain the essential characteristics of this invention and, without departing from the spirit and scope thereof, can make various changes and modifications of the invention to adapt it to various usages, conditions, and embodiments.

I claim:

1. A process of recovering oil from wet mill process corn germ comprising extruding said corn germ as the principal means for oil release, followed by removing oil from said extruded corn germ by extraction.

2. A process of recovering oil from wet mill process corn germ comprising pretreating said corn germ by extruding said corn germ as the secondary means for oil release combined with mechanically expelling said corn germ as the primary means for oil release.

3. The process of claim 1 or 2 comprising adding water to said corn germ prior to said extruding of said corn germ.

4. The process of claim 2, further comprising subsequently extracting oil from said pretreated corn germ.

5. The process of claim 4 wherein a single oil stream is generated by said extracting.

6. The process of claim 4 wherein said extraction is performed with hexane.

7. The process of claim 1 further comprising flaking said corn germ to form flat flakes having a thickness of 0.008–0.012 inches.

8. The process of claim 7, wherein said flaking is conducted at temperatures between 140 and 160° F.

9. The process of claim 7, wherein said corn germ is conditioned prior to said flaking.

10. The process of claim 2 further comprising flaking said corn germ to form flat flakes having a thickness of 0.008–0.012 inches.

11. The process of claim 10, wherein said flaking is conducted at temperatures between 140 and 160° F.

12. The process of claim 10, wherein said corn germ is conditioned prior to said flaking.

13. A process of recovering oil from wet mill process corn germ, comprising the pretreatment steps of:

(a) adding water to dry corn germ to form rehydrated corn germ, (b) conditioning said rehydrated corn germ, (c) extruding said conditioned corn germ through a die to form pellets prior to a step for removing oil from said pretreated corn germ by extraction.

14. The process of claim 13 wherein said pellets have a porous structure.

15. The process of claim 13 further comprising a flaking step after said conditioning step.

16. The process of claim 13 further comprising a chaff removal step prior to said Rehydration step.

17. The process of claim 13 further comprising a chaff incorporation step prior to said extrusion step.

18. The process of claim 13 further comprising a pre-expelling step following said extrusion step.

19. The process of claim 13 further comprising a cooking step following said extrusion step.

20. The process of claim 13 further comprising a pre-expelling step following said rehydration step.

21. The process of claim 13 wherein said step for removing oil comprises full expelling.

* * * * *